United States Patent [19]

Opfer et al.

[11] 4,203,083

[45] May 13, 1980

[54] OPERATING MECHANISM FOR A CIRCUIT INTERRUPTING DEVICE

[75] Inventors: John C. Opfer, Deerfield; Karel E. Vojta, Chicago, both of Ill.

[73] Assignee: S & C Electric Company, Chicago, Ill.

[21] Appl. No.: 930,774

[22] Filed: Aug. 3, 1978

[51] Int. Cl.[2] ..... H01H 9/00; H01H 3/00

[52] U.S. Cl. ..... 335/174; 200/153 SC; 335/190; 335/191

[58] Field of Search ..... 335/172, 174, 189, 190, 335/191; 200/153 SC

[56] References Cited

U.S. PATENT DOCUMENTS

| | | | |
|---|---|---|---|
| 2,555,168 | 5/1951 | Van Ryan et al. | 335/190 X |
| 3,248,497 | 4/1966 | Lindsay | 335/190 |
| 3,845,263 | 10/1974 | Dickinson | 335/190 X |
| 3,956,721 | 5/1976 | Link | 335/189 X |

*Primary Examiner*—Fred L. Braun

*Attorney, Agent, or Firm*—John D. Kaufmann

[57] ABSTRACT

A bus-mountable, circuit-interrupting device, including an interrupting unit and a novel line-potential, manually-resettable operating mechanism for the unit, is usable in circuits in which faults may exceed the interrupting capability of the unit. A normally engaged pair of contacts in the unit is separable within an arc-extinguishing medium. The operating mechanism includes a robust, stored-energy operator, for separating the contacts, and a tripping mechanism, which selectively releases the stored operating energy. The tripping mechanism normally prevents release of the stored operating energy, and includes a high mechanical advantage lever-link system which permits a low latching force to counteract the stored operating energy. A ratchet-solenoid combination in the tripping mechanism selectively removes the low latching force. If a circuit fault occurs, the solenoid moves an arm past, and moves, the ratchet in a first direction, which does not remove the low latching force, but rather stores energy capable of moving the arm in a second direction. Arm movement in the second direction, which occurs immediately in the case of a fault within the interrupting capability of the interrupting unit, moves the ratchet so as to remove the low latching force, permitting the stored operating energy to overcome the latch and move the lever-link system, thereby separating the contacts. If the fault exceeds the interrupting capability of the unit, the arm moves in the first direction, but is prevented from moving in the second direction until the circuit is otherwise opened, as by an upstream protective device.

28 Claims, 14 Drawing Figures

10
14
111
66
113
18
30
24
40
68
36
28
24
22
20
32
12
26
42
43
46
47
44

166
164
152
168A
168B
168
(a)
170
173
173A
172
171
152
(b)

78
86
8
8
122
134
136
76
102
104
132
70
137
140
88
135
129
92
94
130
72
148
124
146
138
128
126
164
166
152
142
168a
154
150
7
7
173
168
108
173A
168b
162
170
190
160
176
202
200
144
109
155
172
198
106
190
189
186
194
186
182
188
184
204
180
192
107
9
206
9
210

86
78
76
70
122
102
104
134
136
132
135
137
88
146
92
94
104
148
138
140
72
124
127
142
162
158
154
150
152
160
176
155
108
109
106
107
208
204
206
192

OPERATING MECHANISM FOR A CIRCUIT INTERRUPTING DEVICE

BACKGROUND OF THE INVENTION

1. Field of the Invention

This invention relates to an operating mechanism for a circuit interrupting device, and more specifically relates to a simple, reliable, inexpensive, and reusable line-potential operating mechanism for a bus-mountable, manually-resettable, circuit interrupting device, which device may be used in circuits in which faults may exceed the interrupting capability of an interrupting unit of the device.

2. Prior Art

Various types of circuit interrupting devices—including fuses or fuse-like devices, circuit breakers, reclosers, and circuit switchers—are well known for circuit protection. These devices have varying operational characteristics and features which make their use technically attractive in some environments, but technically less attractive in others. In the past, operational features tended to be the only criteria determining which type of device was to be used. Today, however, the relative cost of the devices is becoming an important, if not the most important, determinant in deciding which device shall be used in a particular environment. Users of these devices are today often willing to forgo purchasing exotic, broad-range interrupting capability devices in favor of inexpensive, simple devices, even though the latter may have more limited interrupting capabilities.

One use environment in which users today are inclined to employ less expensive, simple devices is that of transformer protection. Devices which up to now have been employed for transformer protection have been either (1) complicated or expensive or both, or (2) if simple or inexpensive, not re-usable. Economic conditions have forced equipment users, especially utilities, to consider employing transformer-protective devices which are not broad-range, and are therefore less versatile or sophisticated, but which are at the same time substantially less expensive. Specifically, many utilities have come to realize that there are times when it is expeditious to use an inexpensive interrupting device having a more limited interrupting rating, as opposed to a broad-range interrupting device, if the inexpensive device is sufficiently less expensive than alternative broad-range devices, so as to make the use of the former attractive from a capital investment standpoint. The attractiveness of such inexpensive devices is enhanced if they are re-usable. Thus, one object of this invention is the provision of a reliable, inexpensive, simple and re-usable interrupting device having limited interrupting capability.

If a broad-range device, such as a circuit breaker, is used as the sole device protecting a transformer, several potential negative aspects, in addition to its high cost, may be present. First, the impedance of the transformer and of the conductors between the transformer and the breaker may so limit currents on the transformer's primary caused by secondary faults that the breaker does not timely respond. Second, because of their high cost, it is often expedient to apply breakers to protect several branch circuits fed by a larger transmission or distribution circuit. In this event, operation of the breaker due to a secondary fault in the transformer located in one such branch circuit de-energizes all such branch circuits. Thus, a fault in one part of a system may render inoperative a large portion of the system. If the breaker is moved closer to the transformer and does not involve branches other than the one in which the transformer is located, it may be under-utilized, having the ability of more extensive system protection. Such under-utilization is unattractive from a cost standpoint.

Placement of a relatively cheap protective device—such as a fuse—intermediate the breaker (protecting several branches) and the transformer (in one of the branches) is an obvious expedient. However, until recently, choices of such cheaper devices have been limited. Moreover, where fuses are used, they must be replaced or replenished following performance of their protective function. Fuse-like devices which are reliable, relatively inexpensive and partly re-usable have only lately become available. See, for example, the following commonly-assigned, U.S. patent applications: Ser. Nos. 909,144 and 909,145 in the names of O. Meister and T. J. Tobin; and Ser. No. 909,146, now U.S. Pat. No. 4,161,711 in the name of O. Meister; all filed on May 24, 1978. Nevertheless, another object of the present invention is to provide a reliable, inexpensive, and re-usable limited fault-interrupting capability device as an alternative to fuses, fuse-like devices and breakers for placement between a transformer and a more expensive, broad-range interrupting device.

Most prior art interrupting devices include various types of "intelligence" and sensing schemes. The "intelligence" processes information provided by the sensing, which information relates to the current flowing in an electrical circuit. The "intelligence" dictates the operation or lack of operation of the device based on such information. Various sensing and "intelligence" schemes are well known; some are simple, while others are quite complex. One common characteristic of many present-day transformer protective devices, other than fuses, is the location of the "intelligence" at ground potential while the sensing and the device are at line potential. This location, of course, necessitates electrical insulation and isolation between the "intelligence," on the one hand, and the sensing and the device, on the other hand. This requirement for isolation, in turn, leads to the use of complex mechanical and electrical schemes for interconnecting the sensing and the "intelligence" to each other and to the circuit interrupting device.

Accordingly, it is desirable to provide a simple, reliable, inexpensive interrupting device, having a limited interrupting rating, but which nevertheless is attractive in view of its low cost, which is completely bus- or line-mountable, and which operates entirely at bus or line potential. Such a device is even more attractive should its entire sensing and "intelligence" be at line or bus potential, thus obviating the need for complex interconnections between the interrupting device and its "intelligence" and sensing. From a cost standpoint, it is also desirable that such a device be re-usable and manually resettable from the ground to obviate the necessity of expensive and complicated reclosing mechanisms. Toward these ends, the present invention is aimed.

The present invention is also aimed at providing a simple, reliable, low-cost operating mechanism for a variety of known interrupting units, wherein fault-interrupting ability is achieved at low cost.

SUMMARY OF INVENTION

The present invention relates to an operating mechanism especially useful for selectively operating a circuit interrupting device. The device may have an interrupting unit of the type which includes a pair of normally engaged, current-carrying contacts. The contacts are separable in an interrupting medium to interrupt the circuit. The operating mechanism includes a stored-energy operator and a tripping mechanism which selectively (1) prevents release of the stored energy to keep the contacts engaged and (2) permits release of the stored energy to separate the contacts. The tripping mechanism includes a high mechanical advantage lever-link system which latches the stored energy when a low latching force is applied to the system. Also included is a movable member, which in moving in a first direction, stores energy capable of removing the low latching force. The member moves in a second direction solely under the influence of the stored latching-force-removing energy. A ratchet removes the low latching force from the lever link system only when the movable member moves in the second direction.

In a preferred embodiment, the movable member does not move and the low latching force is continuously applied to the lever-link system as long as the current in the circuit is normal. If the current is higher than normal but within the interrupting capability of the interrupting unit, the movable member is first moved in the first direction, without affecting the low latching force, to store the latching-force-removing energy. Immediately thereafter, the stored latching-force-removing energy is permitted to move the movable member in the second direction, which movement causes the ratchet to remove the low latching force from the lever-link system. The stored operating energy is thereby released to separate the contacts. If the current in the circuit is higher than normal and exceeds the interrupting capability of the interrupting unit, the movable member is moved in the first direction as before, but is prevented from moving in the second direction until the current is at least within the interrupting capability of the interrupting unit.

DETAILED DESCRIPTION

Figure 1:
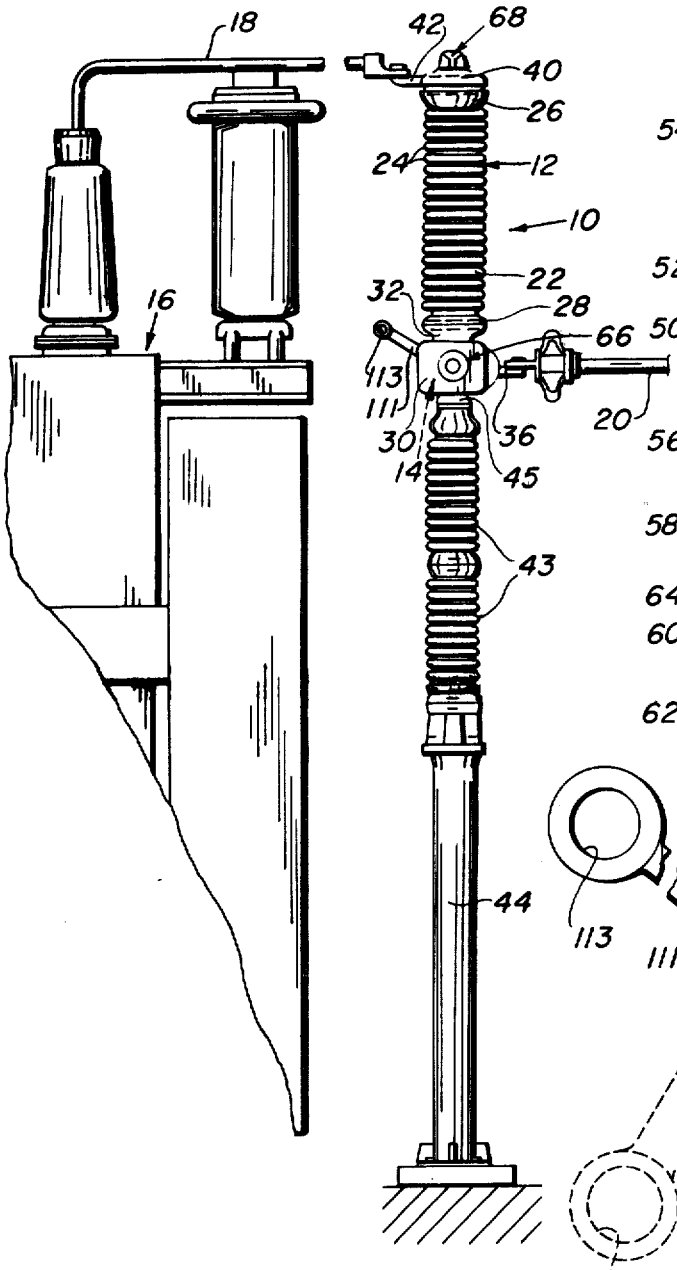
FIG. 1 is a side elevation of a vertically-oriented circuit interrupting device, including an interrupting unit and a novel operating mechanism therefore according to the present invention.
Figure 2:
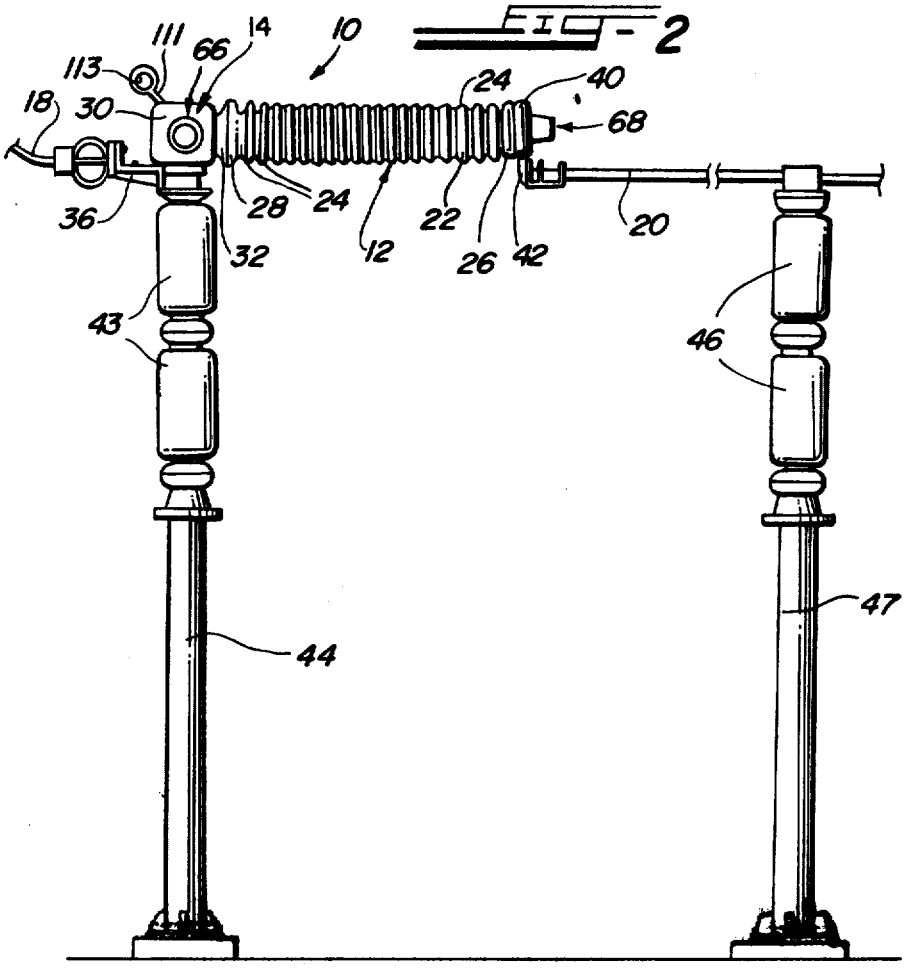
FIG. 2 is a side elevation similar to FIG. 1 in which the interrupting device is horizontally oriented.

General—FIGS. 1 and 2

Referring first to FIGS. 1 and 2, there is shown a circuit interrupting device 10 comprising an interrupting unit 12 and novel operating mechanism 14 according to the present invention. The interrupting device 10 provides protection for a transformer 16 (shown generally only in FIG. 1). Preferably, as shown in FIG. 1, the device 10 is oriented so that the interrupting unit 12 is vertically mounted between buses 18 and 20. The device 10 may also be oriented so that the interrupting unit 12 is horizontally mounted between the buses 18 and 20 (as in FIG. 2) or in any other convenient orientation.

In both FIGS. 1 and 2 the transformer 16 is downstream of the device 10 which is connected thereto by the bus 18. Upstream of the interrupting device 10, and connected in the bus 20 between a power source (not shown) and the device 10, is a broad range fault interrupting device such as a circuit breaker (not shown) which opens the circuit 18, 20 to the transformer 16 should an overcurrent or fault current occur which is not interrupted by the device 10. The interrupting unit 12 of the device 10 has a limited fault current or overcurrent interrupting rating. That is, the interrupting unit 12 is designed to interrupt the circuit 18, 20 to the transformer 16 should overcurrents or fault currents within a predetermined range occur, but is unable to interrupt overcurrents or fault currents in excess of the maximum of this range.

Referring to FIG. 1, the interrupting unit 12 includes an elongated, generally cylindrical, insulative interrupting unit housing 22. The interrupting unit housing 22 is hollow, is made of porcelain or other insulative material, and may include a plurality of skirts 24 for increasing the leakage distance over the outside thereof, as is well-known. Affixed by cementing or the like to the ends of the interrupting unit housing 22 are metal mounting flanges 26 and 28. A metal operating mechanism housing 30 is mounted to one end of the interrupting unit housing 22 by attaching an integral mounting flange 32 thereon to the mounting flange 28 by bolts 34 (see FIGS. 3 and 4) or the like. The operating mechanism housing 30 includes a conductive terminal pad 36 oriented at right angles to the axis of the interrupting unit housing 22 and connected by appropriate facilities to the bus. The mounting flange 28 may seal one end of the interrupting unit housing 22, as hereinafter described. Mounted by bolts 38 or the like (see FIG. 3) to the mounting flange 26 at the other end of the interrupting unit housing 22 is a metal end plate 40 which seals the other end of the interrupting unit housing 22. A conductive terminal pad 42 oriented at right angles to the axis of the housing 22 and integral with the end plate 40 is connected in FIG. 1 by appropriate facilities to the bus 18. The device 10 is thus connected in series between the transformer 16 and the upstream breaker (not shown).

In the preferred arrangement of FIG. 1, the device 10 is supported by an insulator stack 43 which is in turn supported by a support column 44. A pedestal 45 on the operating mechanism housing 30 rests on the stack 43 so that the housing 30 supports the interrupting unit housing 22. Positional stability of the device 10 may be provided by the bus 18, although the pedestal 45 should be sufficiently, firmly attached to the insulator stack 43 to prevent swaying of the device 10.

In the arrangement of FIG. 2, the pedestal 45 is eliminated; the terminal pad 36 is oriented parallel to the axis of the interrupting unit housing 22 and is intermediate the operating mechanism housing 30 and the stack 43 so that one end of the interrupting unit housing 22 and the entire operating mechanism housing 30 are supported by the stack 43. In FIG. 2, the terminal pad 36 is connected to the bus 18. Support for the other end of the interrupting unit housing 22 is provided by a second insulator stack 46 on a second support column 47 which together may support the bus 20. The connection of the bus 20 to the terminal pad 42 supports the other end of the housing 22. The arrangement of FIG. 1 is preferred because it uses one less insulator stack and one less column than the arrangement of FIG. 2.

Under normal conditions, with both the device 10 and the upstream breaker (not shown) closed, current is supplied to the transformer 16 by the power source (not shown) via the bus 20, the device 10 and the bus 18. Should an overcurrent or fault current occur in the circuit 18,20, either the device 10 or the breaker (not shown) will interrupt the circuit 18,20 to protect the transformer 16.

FIGS. 1 and 2 depict one phase of a polyphase high voltage system. Each phase of the system may contain a similar arrangement of elements.

Figure 3:
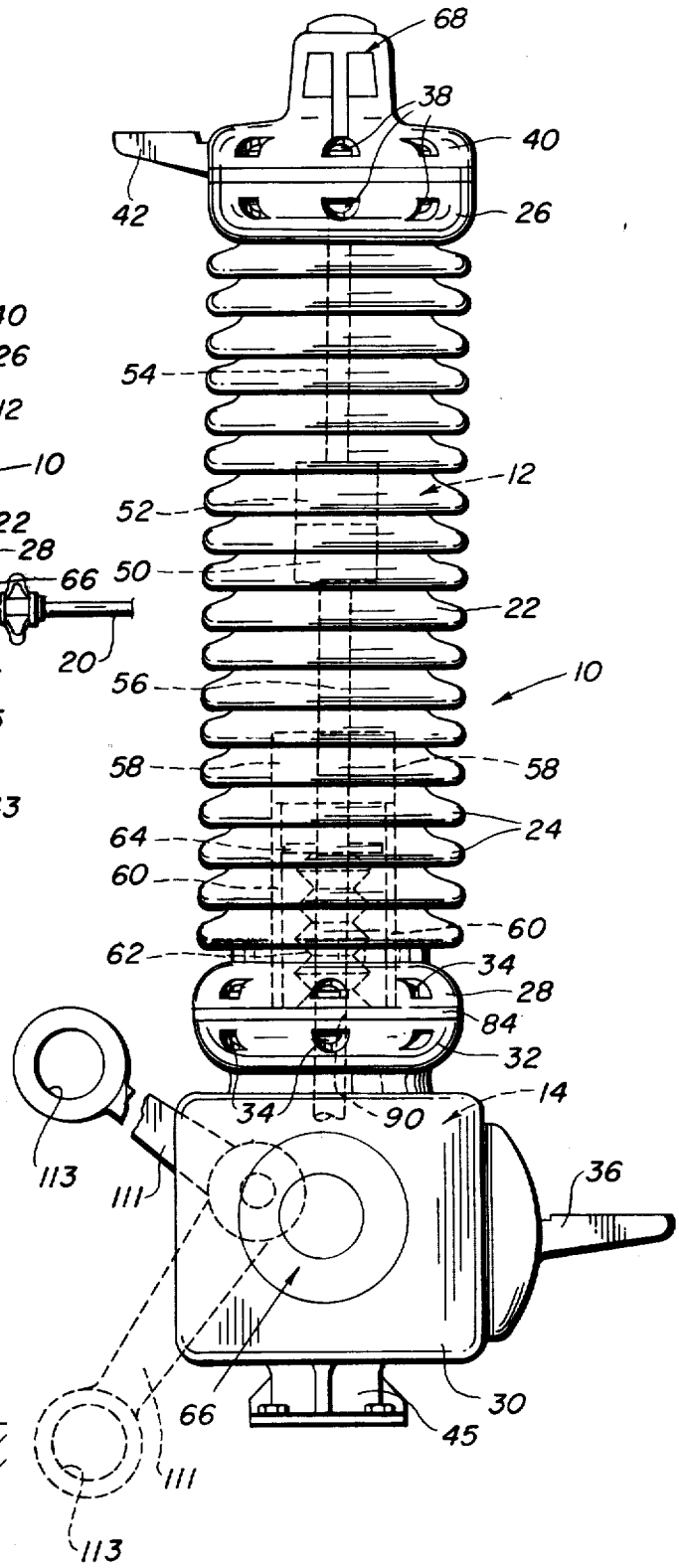
FIG. 3 is an enlarged view of the interrupting device shown in FIGS. 1 and 2, showing in some detail generalized elements contained in the interrupting unit thereof.
Figure 4:
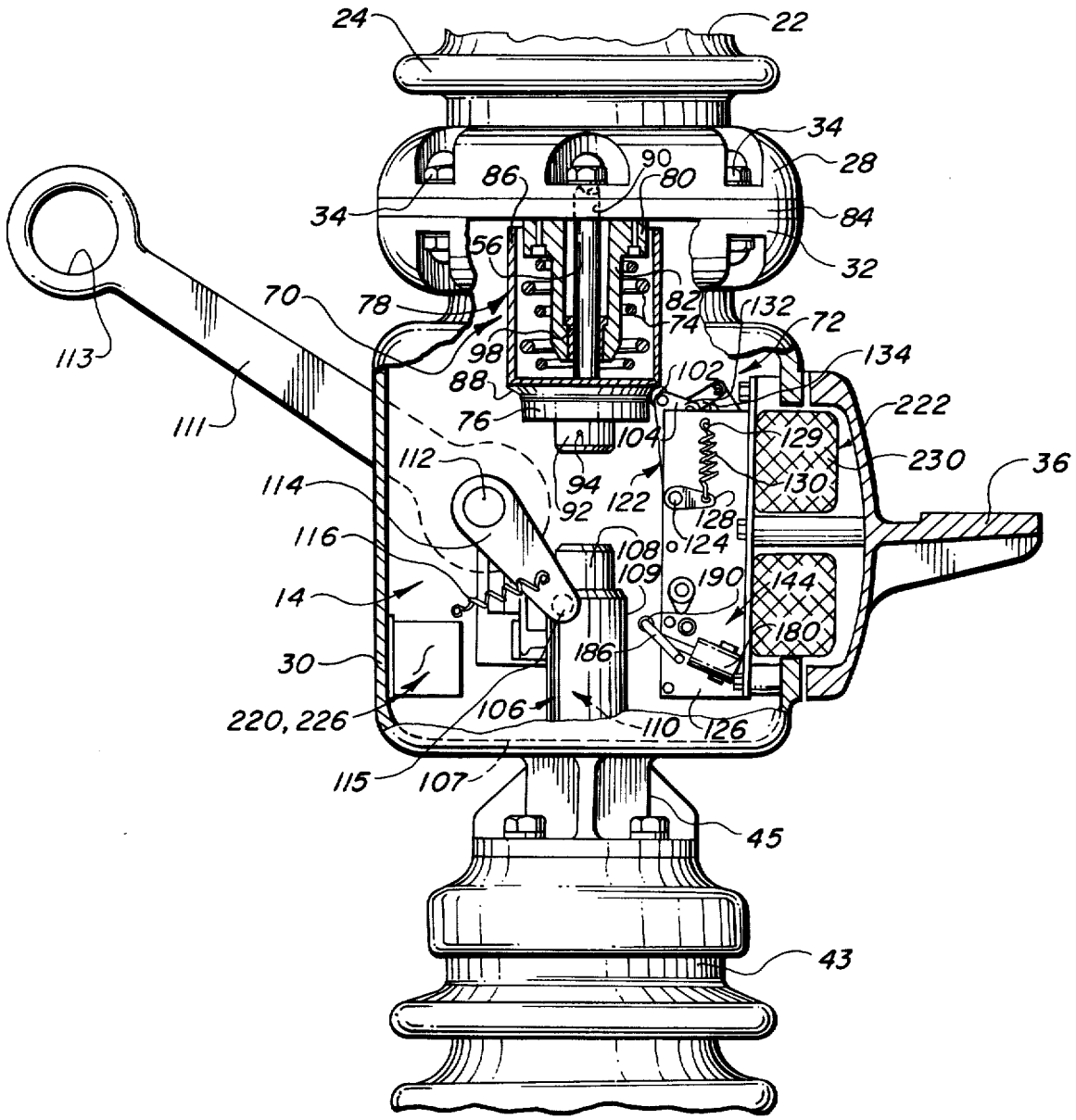
FIG. 4 is a partially-sectioned, side elevation of the novel operating mechanism of the present invention used with the devices depicted in FIGS. 1-3.

Interrupting Unit 12—FIGS. 3 and 4

The interrupting unit 12 may be any known type such, including those shown in commonly-assigned U.S. Pat. Nos. 3,030,481 issued 4/17/62; 3,163,736 issued 12/29/64, 3,508,022 issued 4/21/70; and 3,769,477 issued 10/30/73. As a consequence, only generalized portions thereof are shown in phantom in FIGS. 3 and 4, as the unit 12 itself forms no part of the present invention.

As shown primarily in FIG. 3, the interrupting unit 12 is of the general type wherein a pair of normally engaged, relatively movable and rapidly separable contacts 50 and 52 in the interrupting unit housing 22 are mounted for movement into and out of engagement with each other. Additional pairs of contacts may also be present. The contacts 50 and 52 may take any preferred form, their shape, location and orientation being shown only in a general manner in FIG. 3. Preferably, one contact 50 is movable, while the other contact 52 is stationary, although both contacts 50 and 52 may be movable. Further, separation of the contacts 50 and 52 takes place in the presence of an arc-extinguishing medium, such as $SF_6$ gas contained within the interrupting unit housing 22. Such separation, with or without "puffing" action, effects circuit interruption and extinguishment of the arc struck between the contacts 50 and 52.

The operating mechanism 14 of the present invention is provided for rapidly separating the contacts 50 and 52, as described below.

The stationary contact 52 may be electrically connected to the mounting flange 26 by a conductive member 54. Thus, a first continuous electrical path is formed as follows: The bus 18 (FIG. 1) or the bus 20 (FIG. 2); the terminal pad 42; the flange 26; the member 54; and the stationary contact 52. The movable contact 50 is mounted to a conductive, reciprocable operating rod 56 which is parallel to the axis of the unit housing 22. Selective movement or reciprocation of the rod 56, as hereinafter described, moves the contact 50. One or more sliding contacts 58 may be arranged to electrically contact the rod 56 regardless of its position. The contacts 58 may be connected to the flange 28 by conductive members 60. Thus, a second continuous electrical path is formed as follows: The bus 20 (FIG. 1) or the bus 18 (FIG. 2); the terminal pad 36; the operating mechanism housing 30; the flange 32; the flange 28; the conductive members 60; the contacts 58; the rod 56; and the movable contact 50.

When the contacts 50 and 52 are engaged (the device 10 is "closed"), a continuous electrical path through the device 10 and between the buses 18 and 20 is formed. Should an overcurrent or fault current within the rating of the device 10 occur, the operating mechanism 14 rapidly moves the operating rod 56 (down in FIG. 3) to move the movable contact 50 rapidly away from the stationary contact 52. This movement rapidly elongates the arc terminating on the contacts 50 and 52. Such rapid arc elongation and the action of the $SF_6$ extinguish the arc, as is well-known.

The presence of a medium such as $SF_6$ in the unit housing 22 may necessitate sealing of the ends thereof. To this end, the end plate 40 and/or the flange 26 may be provided with appropriate seals, O-rings or the like (not shown). The movement of the rod 56 in and between both of the housings 22 and 30 requires a different sealing arrangement associated with the flange 28. Specifically, a flexible bellows 62 surrounding the rod 56 may be sealed at one end fo the flange 28 and at the other end to a disk 64 carried by and sealed around the rod 56. Thus, the rod 56 is free to move while the bellows 62 prevents leakage of the $SF_6$ therepast.

The operating mechanism housing 30 may have a contact position indicator, shown only generally at 66, for indicating to an operator at ground level that the contacts 50 and 52 have opened and are not in engagement: A example of such an indicator 66 is shown in commonly-assigned U.S. Pat. No. 3,225,170 issued 12/21/65. The end plate 40 may have a pressure indicating device and/or a pressure relief device generally indicated at 68. The device 68 may indicate whether the pressure of the $SF_6$ (where used) within the interrupting unit housing 22 is proper, and may also vent the interior of the normally sealed housing 22 to atmosphere in the event of an overpressure within the unit housing 22. An example of such a device 68 is shown in commonly-assigned U.S. Pat. No. 3,229,848 issued 1/18/66.

Operating Mechanism 14—Interrupting Unit Operator 70—FIGS. 3, 4, 5, 6 and 10:

The operating mechanism 14 includes a stored-energy operator 70 for the interrupting unit 12 and a tripping mechanism 72 for selectively releasing energy stored in the operator 70 to separate the contacts 50 and 52. The operator 70 and the tripping mechanism 72 are both within the operating mechanism housing 30.

Referring to FIG. 4, the operator 70 includes one helical drive spring 74 or several nested helical springs 74 acting between a cylindrical end member 76 of a movable, spring-confining tube 78 and a stationary reaction member 80. The stationary reaction member 80 may comprise a flange of a support core 82 around which the springs 74 are positioned. The support core 82 may be attached, as by bolts, to a plate 84 which may form a portion of one of the flanges 28 or 32, or may be intermediate, and clamped between, the flanges 28 and 32.

The tube 78 is preferably made of a low density metal, such as aluminum and includes a cylindrical main body 86 closed by the end member 76. The end member 76 has a smaller diameter than the body 86 and is attached thereto in any convenient fashion. The end member 76 exteriorly includes a rounded taper or surface feature 88 between its smaller diameter outer surface and the outer surface of the body 86.

The operating rod 56 extends into the housing 30 through an aperture 90 in the wall 84 (FIG. 3) and, after passing through the support core 82, is attached to the end member 76 in any convenient manner. The attachment method depicted involves attaching the rod 56 to a protrusion 92 formed on the outside of the end member 76 with a cross pin 94. The rod 56 passes through a bronze guide bearing 98, centrally held in a bore formed through the support core 82. Joint movement of the tube 78 and the end member 76 moves the operating rod 56 and the movable contact 50. A roller 102 carried between the ends of a pair of movable arms 104 is movable into and out of engagement with the rounded taper 88. The roller 102 and the arms 104 form a part of the tripping mechanism 72 of the present invention and are both described below in more detail.

When the contacts 50 and 52 are engaged, the springs 74 are compressed between the end member 76 and the reaction member 80, thus storing energy therein. If the roller 102 is held in engagement with the taper 88, the end member 76, the tube 78 and the operating rod 56 cannot move and the contacts 50 and 52 consequently remain engaged or closed. If an overcurrent or fault current condition in the circuit 18,20 within the interrupting rating of the device 10 occurs, as described below, the roller 102 is moved clockwise out of engagement with the taper 88. This permits the sudden release of the energy stored in the springs 74, and the operating rod 56 and the movable contact 50 move rapidly away from the stationary contact 52 to open and interrupt the circuit 18,20. As discussed later, a similar separation of the contacts 50 and 52 occurs following the occurrence of an overcurrent or fault current above the interrupting rating of the device 10, but this separation takes place only after the upstream breaker has opened. In this latter event, separation of the contacts 50 and 52 serves not an interrupting function but rather an opening function which isolates the transformer 16 in the event the upstream breaker subsequently recloses.

The low mass of the tube 78 ensures that the majority of the stored energy in the springs 74 is effective to rapidly separate the contacts 50 and 52. As the contacts 50 and 52 fully separate the energy formerly stored in the springs 74 is converted into high kinetic energy of a moving system including the low mass tube and end member 78 and 76, the operating rod 56, and the movable contact 50. In order to obviate damage to the device 10, this moving system 50,56,76,78 is stopped by a shock absorber 106 mounted to a wall 107 of the housing 30 opposite the wall 84. The shock absorber 106 may be any known type and may comprise a movable piston 108 mounted in a stationary cylinder 109. The cylinder 109 contains energy-absorbing elements 110 such as one or more elastomeric cushions. The piston 108 is arranged so as to be impacted by the protrusion 92 (See FIG. 10) and to be moved into the cylinder 109 thereby, whereupon the cushions 110 slow down and finally stop the moving system 50,56,76,78 by dissipating the kinetic energy. As the protrusion 92 moves toward the piston 108, the roller 102 rides over the surface of the tube 78 which may be covered with a wear-resistant oxide for that reason.

In the preferred form of this invention, once the device 10 has operated, that is, once the contacts 50 and 52 have separated, or opened, they remain separated until they are manually reclosed. To this end, the housing 30 carries an external, rotatable operating handle 111. The handle 111 is fixed at one end to a rotatable shaft 112 which passes through, and is appropriably journalled for rotation in, the housing 30. The handle 111 has an aperture 113 at its other end into which a hook (not shown) or the like on the end of an insulated pole or "hot stick" (not shown) may be inserted. Thus, an operator on the ground may stand adjacent the support column 44 and insert the hook into the aperture 113, following which he may rotate the handle 80 in a counterclockwise direction.

The shaft 112 carries a pair of opposed recocking arms 114 (only one being visible in FIG. 4) within the housing 30. Each of the arms 114 carries a stud 115 selectively engageable with the end member 76. A return spring 116 or similar member may be connected between one of the arms 114 and the housing 30 to normally bias the handle 111 and the arms 114 clockwise to their normal positions shown in FIGS. 1–4. In such normal position, the handle 111 and the arms 114 may be rotated about 15° before the studs 115 engage the end member 76 following movement of the tube 78 to open the contacts 50 and 52. Thus, if the tube 78 has moved to open the contacts 50 and 52, both the handle 111 and the arms 114 may be rotated counterclockwise about 15° by the hook stick before the studs 115 engage the end member 76. Similarly, if the contacts 50 and 52 are closed, the handle 111 and the arms 114 may be rotated counterclockwise up to 15° without the possibility that the end member 76 will strike the studs 115 should the contacts 50 and 52 separate during, or at the termination of, such rotation. The above-described 15° of rotation is exemplary only and is for a purpose set forth below. Of importance is some degree of limited rotation of the handle 111 and the arms 114 without the possibility of contact between the end member 76 and the studs 115 regardless of the position of the contacts 50 and 52. Such limited rotation is easily achieved by appropriate selection of the size, location and configuration of the shock absorber 106, the arms 114 and the studs 115.

To reclose the contacts 50 and 52 once they have opened, the operator rotates the handle 111 counterclockwise. This action rotates the arms 114 and the studs 115 through 15° until the studs 115 contact the end member 76. Continued rotation of the handle 111 causes the studs 115 to move the end member 76, the tube 78, the operating rod 56 and the movable contact 50 back toward the stationary contact 52 against the springs 74. When the contacts 50 and 52 again engage, and the springs 74 are thereby fully re-charged, the roller 102 is moved counterclockwise to re-engage the taper 88, latching the contacts 50 and 52 closed as described earlier. Release of the handle 111 by the operator permits the return spring 116 to move the handle 111 and the arms 114 back to their normal positions of FIG. 4. A stop member (not shown), such as a pin in the rotational path of the handle 111 or the arms 114 and fixed to the housing 30, may limit clockwise rotation of the handle 111 and the arms 114 by the return spring 116.

Operating Mechanism 14—Tripping Mechanism 72—Main Latch 112—FIGS. 5-6,8 and 10

The tripping mechanism 72 includes the roller 102 and the arms 104 for selectively latching and releasing energy stored in the springs 74 to separate the contacts 50 and 52. The roller 102 and the arms 104 in their normal positions FIGS. 4,5,6 and 8) latch this stored energy in the springs 74 and maintain the contacts 50 and 52 normally engaged. Movement of the roller 102 away from the taper 88 releases this energy, as described above. The roller 102 and the arms 104 constitute a part of a main latch 122 of the tripping mechanism 72 for selectively latching or releasing energy stored in the springs 74.

Figure 5:
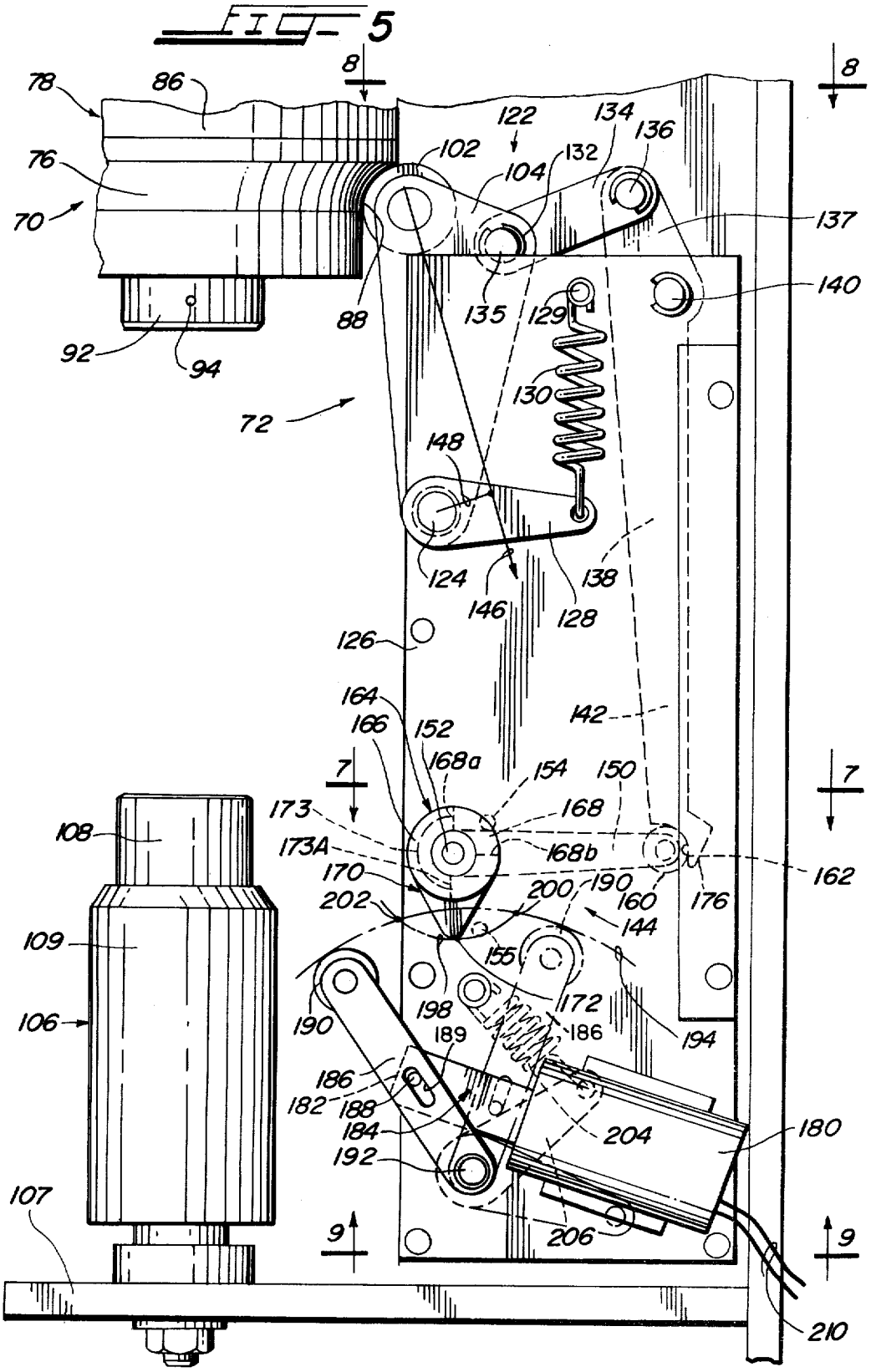
FIG. 5 is an enlarged view of a portion of the operating mechanism shown in FIG. 4 at a time when the operating mechanism latches stored operating energy for the interrupting unit of FIGS. 1-3.
Figure 6:
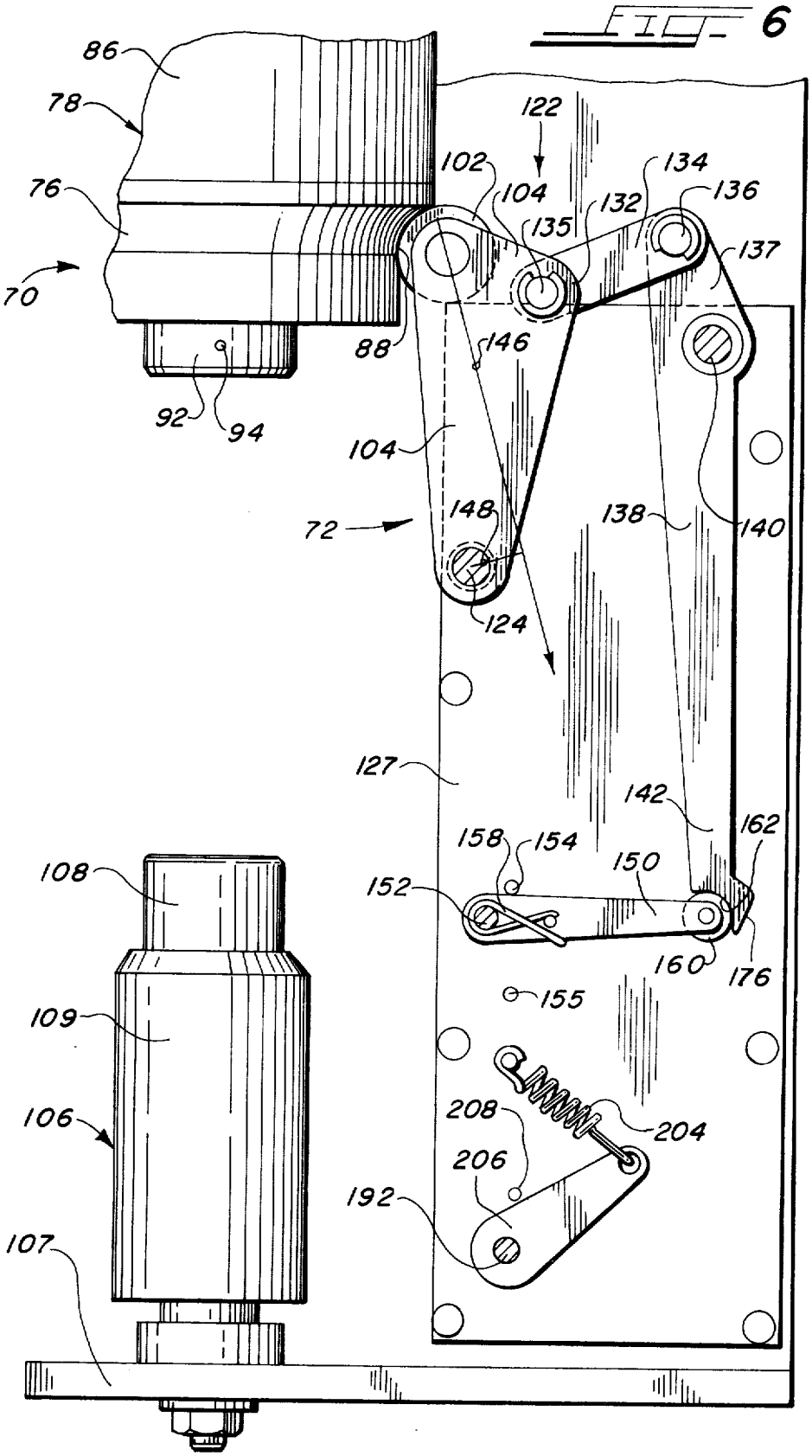
FIG. 6 is similar to FIG. 5, but is taken from a different aspect.
Figure 8:
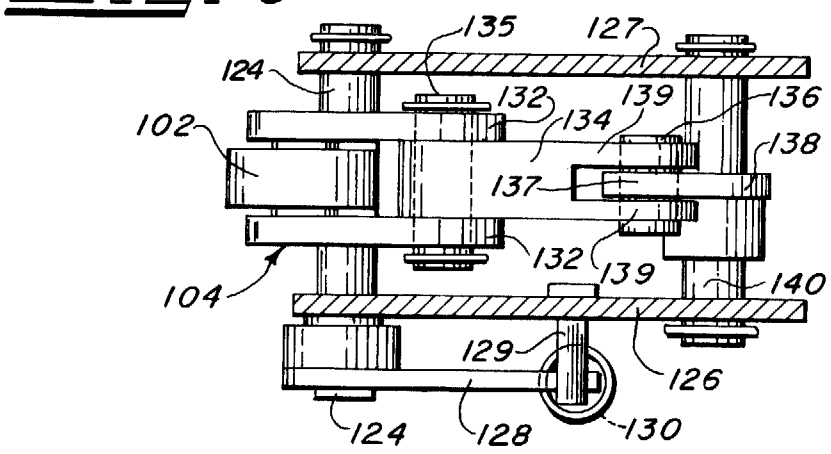
FIGS. 7-9 are respectively taken along lines 7—7, 8—8, 9—9 of FIG. 5 and show in greater detail various elements of the novel operating mechanism of this invention.
Figure 9:
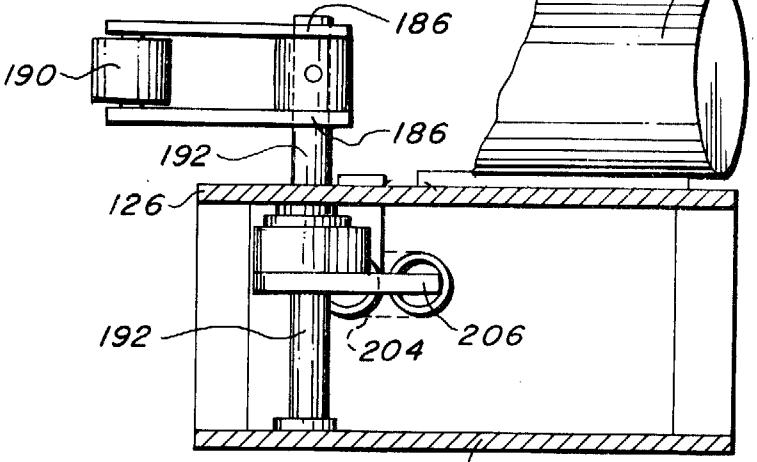

Referring to FIGS. 5,6 and 8, the arms 104 are shown as class 3 levers fixed to a shaft 124 remote from the roller 102. The shaft 124 is journalled at each end for rotation in a pair of stationary support plates 126 and 127, which may be mounted within, or may form a part of, the housing 30. The arms 104 may be located between the plates 126 and 127. A return arm 128 (FIGS. 5 and 8) is fixed at one end to the shaft 124. Connected between the other end of the return arm 128 and a pin 129 on one of the support plates 126 is a return spring 130 which biases the shaft 124 in a counterclockwise direction to normally position the roller 102 in engagement with the taper 88. Should the arms 104, the roller 102 and the return arm 128 be rotated clockwise, as hereinafter described, the disengagement of the roller 102 from the taper 88 permits release of the stored energy in the springs 74. Such release permits the tube 78 to move leftwardly as the contacts 50 and 52 separate, while the return spring 130 maintains the roller 102 in contact with the exterior of the tube 78 over which the roller 102 rides. Following reclosing of the contacts 50 and 52, as described above, the return spring 130 ensures re-engagement of the roller 102 with the taper 88 to latch the energy again stored in the springs 74.

The arms 104 include portions 132 offset from the line defined by the shaft 124 and the roller 102. One end of a link 134 is pivotally connected by a pin 135 between the offset portions 132. The other end of the link 134 is pivotally connected by a pin 136 to a first end 137 of an elongated class 1 lever 138 which resides between bifurcations 139 (FIG. 8) of the link 134. The lever 138 is pivoted on a pin 140 attached between the support plates 126 and 127. Once the return spring 130 has caused the roller 102 to re-engage the taper 88, if clockwise rotation of the first end 137 of the lever 138 is prevented, the roller 102 prevents separation of the contacts 50 and 52. If the first end 137 of the lever 138 is free to rotate clockwise, the link 134 moves down concurrent with clockwise rotation of the arms 104 and of the roller 102, due to the force of the springs 74 acting on the roller 102 as set forth below. Thus, it is not necessary to apply a rotative force to the arms 104 other than that applied by the springs 74, if the first lever end 137 is free to rotate, the springs 74 achieve that end and are free to separate the contacts 50 and 52. While the return spring 130 biases the first end 137 of the lever 138 counterclockwise via the link 134, it is unable by itself to counteract the force of the springs 74.

A second end 142 of the lever 138 is substantially farther from the pin 140 than is the first end 137, a ratio within the range of about 5:1 to 7:1 being preferred for a purpose described below. In the normal position of all the elements of the tripping mechanism 72 thus far described, and as shown in FIGS. 5,6 and 8, the second end 142 of the lever 138 is held in a fixed position by a latch operator 144 which prevents clockwise rotation of this second end 142, about the pin 140. Such holding of the second end 142 of the lever 138 also holds the first end 137, preventing its clockwise rotation about the pin 140. Because the second lever end 142 cannot rotate clockwise, the link 134 props the arms 104 in their normal position preventing movement of the tube 78.

Four salient features of the tripping mechanism 72 should at this point be noted. First, the second lever end 142 is farther from the pin 140 than the first lever end 137. Accordingly, the force holding the second lever end 142 against the action of the springs 74 on the first end 137 via the link 134 is substantially less than the force such springs 74 exert on the first end 137. This low holding or latching force is of such a moderate value that its application to the second end 142 is easily achieved.

Second, should the holding or latching force on the second lever end 142 be released, the force of the compressed springs 74 acting along a line 146 to rotate the arms 104 is sufficient by itself to move the roller 102 and the arms 104 clockwise so that the roller 102 no longer latches this spring force. The springs 74 are now free to disengage the contacts 50 and 52. The release of the force of the springs 74 is accompanied by clockwise motion of both lever ends 137 and 142 and by rightward movement of the link 134. The return spring 130 continues to bias the arms 104, the link 134 and the lever 138 toward their normal positions. The size of the roller 102 and the contour of the taper 88 are so selected that removal of the holding force from the second lever end 142 causes nearly instantaneous release of the energy stored in the springs 74.

Third, the force of the springs 74, acting as it does along the line 146, puts the arms 104 primarily in compression with only a slight bending moment thereon. It is well within the skill of the art to design the arms 104 from easily obtained materials which can easily withstand without damage the compressive forces exerted by the springs 74. Also, the relationship of the offset portions 132, the link 134 and the lever 138 is such that the forces exerted on the first lever end 137 are quite reasonable. This is because a resolution of the force acting along the line 146 into components acting along the arms 104 and along the link 134, shows the great majority of force to be acting along the arms 104.

Fourth, the moment on the arms 104 due to the force of the springs 74 acting along the line 146 has a short radius 148 measured between the center of the shaft 124 and the line 146. The short radius 148 ensures that the majority of the force compresses the arms 104 and need not be resisted by the lever 138. It also ensures that freedom of the second lever end 142 to rotate will permit the force of the springs 74 to rotate the arms 104 and the roller 102 to permit opening the contacts 50 and 52.

Thus, the main latch 122 permits a small holding or latching force at the second lever and 142 to latch the substantially larger force of the springs 74, and further permits mere removal of this holding or latching force to release the stored energy in the springs 74.

Operating Mechanism 14—Tripping Mechanism 72—Latch Operator 144—FIGS. 4–7,9 and 10

The latch operator 144 includes a bifurcated latch arm 150 (See FIG. 7) mounted at one end on an elongated shaft 152 journalled for rotation in the support plates 126 and 127. Counterclockwise rotation (as in FIGS. 5,6 and 10) of the latch arm 150 is limited by a pin 154 fixed to one of the support plates 127. Clockwise rotation (as in FIGS. 5,6 and 10) of the arm 150 is similarly limited by a pin 155 (See FIG. 6) fixed to the same plate 127. The arm 150 is biased counterclockwise against the pin 154 by a spring 158 (FIGS. 6 and 7) which acts between the arm 150 and a pin in one of the support plates 126. Clockwise rotation of the shaft 152 rotates the arm 150 clockwise against the spring 158 until the arm 150 strikes the pin 155.

The other end of the arm 150 carries a pivotal roller 160 between its furcations. In the normal position of the arm 150 against the pin 154 (FIGS. 5–7), the roller 160 normally engages a complementary surface 162 formed in the second end 142 of the lever 138. When the arm 150 is in the normal position shown in FIG. 4, the arm 150 and the roller 160 prevent clockwise movement of both ends 137 and 142 of the lever 138 and prevent separation of the contacts 50 and 52, as described above. In this condition, the arm 150 is entirely in compression; small clockwise rotational forces on the arm 150 due to the interaction between the surface 162 and the roller 160 are counteracted by the spring 158. Thus, in its normal position, the arm 150 is able to resist the small compressive force theron preventing separation of the contacts 50 and 52.

Figure 7:
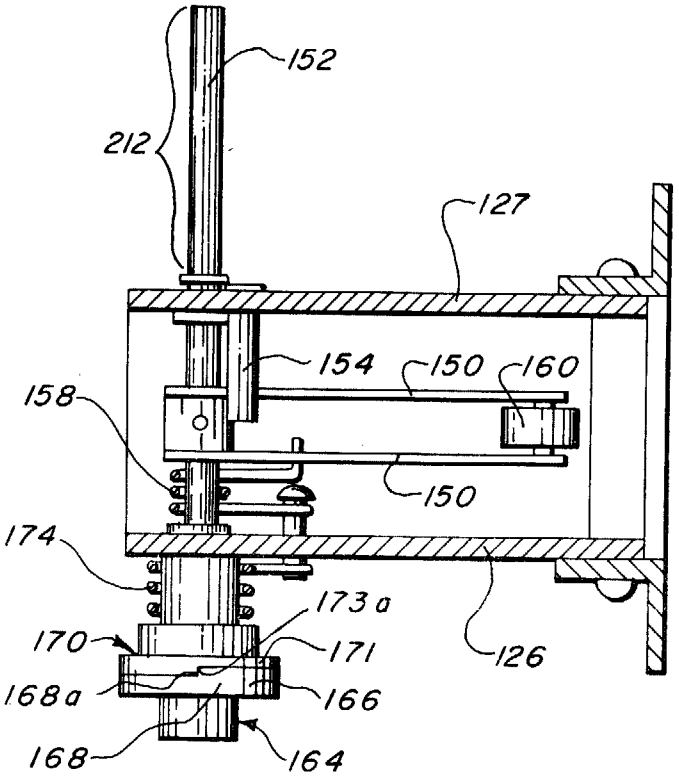

The shaft 152 extends beyond the support plates 126 and 127 (FIGS. 7). Pressed onto one end of the shaft 152 is a shaft-rotating member 164, best seen in FIG. 11*a*. The member 164 has a generally cylindrical body 166 with a raised projection or tooth 168 formed thereon facing the adjacent support plate 126. The tooth 168 is wedge-shaped and extends over an arc of about 90° of the member 164. The tooth 168 defines a first lateral surface 168A and a second lateral surface 168B. The spring 158 and the pin 154 are arranged so that when the latch arm 50 is in its normal position, the first surface 168A of the tooth 168 is horizontal, as shown. Counterclockwise rotation of the member 164 is prevented by the pin 154. Clockwise rotation of the member 164 rotates the shaft 152 and the arm 150 to free the second end 142 of the lever 138 so that the contacts 50 and 52 may separate.

Figure 11:
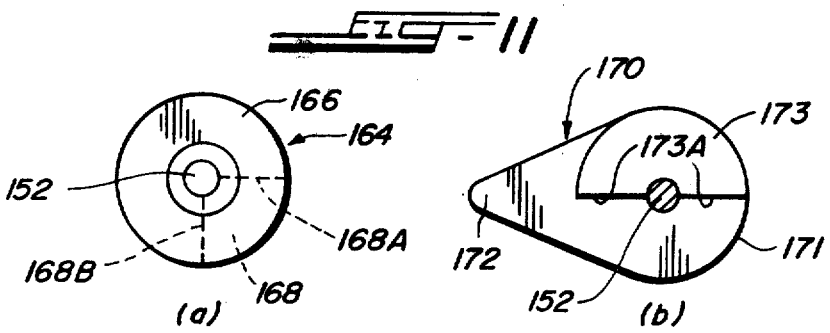
FIGS. 11 (*a*) and 11 (*b*) are enlargements of certain elements of the novel mechanism as depicted in FIGS. 4, 5 and 7.

Between the member 164 and the adjacent support plate 126, and freely rotatable on the shaft 152, is a flipper 170 best shown in FIG. 11*b*. The flipper 170 includes a cylindrical body 171 positioned about the shaft 152 and an extended cam arm 172 integral with the body 171. Formed on the end of the body 171 facing the body 166 of the member 164 is a raised projection or tooth 173. The tooth 173 extends over an arc of 180° of the body 171 and defines a lateral surface 173A. The surface 173A of the tooth 173 and the surfaces 168A and 168B of the tooth 168 are so related that limited counterclockwise rotation (here 90°) of the body 171 and of the cam arm 172 can occur without interference from, and without affecting the position of, the member 164. Specifically, the surface 173A is free to rotate counterclockwise away from the surface 168A; counterclockwise rotation continues until the surface 173A strikes the surface 168B; retrograde clockwise rotation of the flipper 170 can freely occur until the surface 173A again strikes the surface 168A. Contrariwise, if the surface 173A already abuts the surface 168A, clockwise rotation of the cam arm 172 and the body 171 causes clockwise rotation of the member 164 and of the shaft 152, which in turn rotates the latch arm 150 clockwise permitting separation of the contacts 50 and 52.

A coil spring 174 (FIG. 7) acts between the body 171 and the adjacent support plate 126 to bias the body 171 and the cam arm 172 clockwise so that the surface 173A normally abuts the surface 168A. Thus, with the latch arm 150 in its normal position against the pin 154 due to the spring 158, the surface 168A is horizontal. The spring 174 holds the surface 173A against the surface 168A so that the cam arm 172 is also horizontal.

Figure 10:
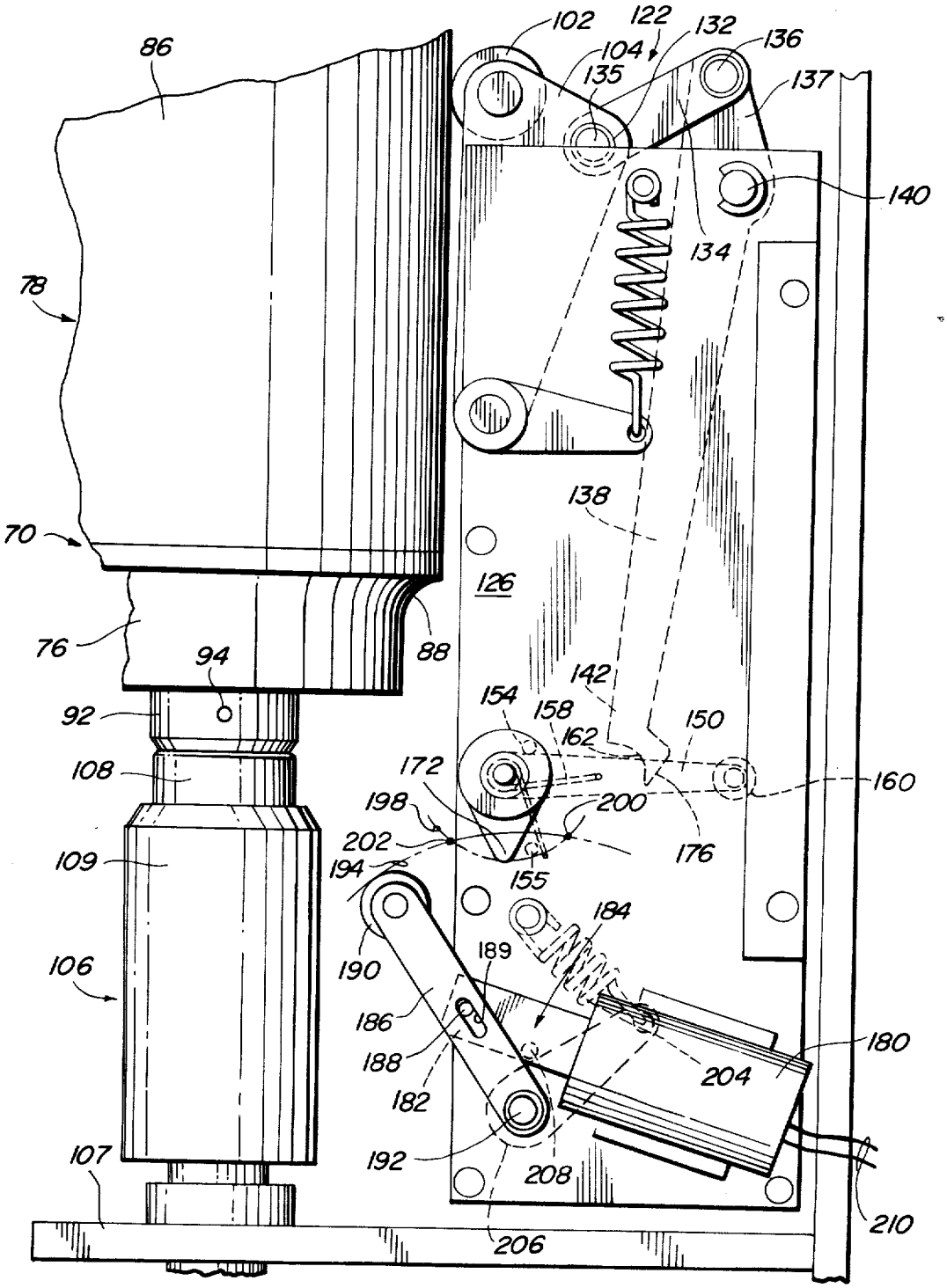
FIG. 10 is similar to FIG. 5, but shows the operating mechanism of this invention at a time after the stored operating energy has been released.

Counterclockwise rotation of the cam arm 172 moves the surface 173A away from the surface 168A and has no effect on the normal position of the latch arm 150. Following such rotation, the cam arm 172 returns to its normal position under the action of the spring 174, again having no effect on the position of the latch arm 150. Subsequent (or initial) clockwise rotation of the cam arm 172 causes the surface 173A to push against and move the surface 168A to rotate the shaft 152 and the latch arm 150 clockwise. Such movement of the latch arm 150 releases the second end 142 of the lever 138 so that the energy in the springs 74 is released. Following this operation, the spring 158 returns the latch arm 150 to its normal position against the pin 154 (See FIG. 10). As shown in FIG. 10, following separation of the contacts 50 and 52, the roller 102 riding on the tube 78 maintains the lever 138 rotated clockwise from its normal position. The second end 142 of the lever 138 is between the furcations of the arm 150 at this time. When the contacts 50 and 52 are reclosed by operation of the handle 111 the roller 102 re-enters the taper 88, and the roller 160 and the arm 150 are moved slightly clockwise by a surface 176 on the second lever end 142 until the roller 160 re-enters the surface 162 due to the action of the spring 158.

Thus, the flipper 170 and the member 164 form a type of one-way ratchet, wherein rotation of the cam arm 172 counterclockwise has no effect on the latch arm 150, while clockwise rotation of the cam arm 172 effects clockwise rotation of the latch arm 150 and the consequent release of the energy in the springs 74.

The latch operator 144 also includes a solenoid 180 mounted to one of the support plates 126. A connector portion 182 of the movable core 184 of the solenoid 180 is connected to the middle of a bifurcated trip lever 186 by a pin 188 fixed to the portion 182 and slidably held in slots 189 formed in the furcations of the lever 186 which permit the lever 186 to rotate as the solenoid core 184 reciprocates. The trip lever 186 carries a roller 190 between its furcations remote from a shaft 192 which mounts the trip levers 186 and is journalled to rotate in the support plates 126 and 127. A locus 194 defined by the roller 190 as the trip lever 186 rotates with the shaft 192 is such that the roller 190 is engageable with the cam arm 172. A locus 198 of rotation of the cam arm 172 end is such that starting with the cam arm 172 in its normal location:

(a) Clockwise rotation of the trip lever 186 from the left of the cam arm 172 (solid lines in FIG. 5) effects, in order, engagement between the roller 190 and the cam arm 172, counterclockwise rotation of the cam arm 172, disengagement of the roller 190 from the cam arm 172 at a point 200, and return of the cam arm 172 to its normal location; and (b) counterclockwise rotation of the trip lever 186 from the right of the cam arm 172 (dotted lines in FIG. 5) effects, in order, engagement between the roller 190 and the cam arm 172, clockwise rotation of the cam arm 172, disengagement of the roller 190 from the cam arm 172 at a point 202, and return of the cam arm 172 to its normal location.

Thus, in accordance with earlier discussion, clockwise rotation of the lever 186 from the left causes counterclockwise rotation of the cam arm 172 and has no effect on release of the latched energy from the springs 74, while counterclockwise rotation of the lever 186 from the right causes clockwise rotation of the cam arm 172 and effects release of this energy.

A return spring 204 is connected between an arm 206 fixed to the shaft 192 and one of the support plates 127 to maintain the arm 206 in a normal position against a stop pin 208 whereat the lever 186 is maintained to the left of the cam arm 172, as in FIG. 5. Should an appropriate electrical signal be applied to the solenoid 180 on leads 210 thereof, the core 184 is pulled into the solenoid 180 against the return spring 204 for as long as the signal persists. This movement of the core 184 causes clockwise rotation of the lever 186 and has no effect on the release of the energy from the springs 74. Cessation of the signal on the leads 210 permits the return spring 204 to return the lever 186 to its normal location, effecting clockwise rotation of the cam arm 172 and release of the energy stored in the springs 74. Thus, the energy to permit the main latch 122 to release the energy stored in the springs 74 is stored in the spring 204 following initial movement of the levers 186 by the solenoid 180. Assuming the contacts 50 and 52 to be closed or engaged, and all of the elements to be in their normal positions of FIGS. 4–6, three possibilities are present.

(1) If no input is present on the leads 210, the operating mechanism 14 is inactive, and the contacts 50 and 52 remain closed.

(2) If the momentary input is present on the leads 210, the lever 186 first moves clockwise and then rotates back counterclockwise due to the spring 204, the latter rotation effecting release of the energy in the springs 74 to open the contacts 50 and 52.

(3) If a persistent input is present on the leads 210, the lever 186 moves clockwise and is held in a position to the right of the cam arm 172. This results in continued latching of the energy in the springs 74 and continued engagement of the contacts 50 and 52. When the persistent input is terminated for any reason, the return spring 204 returns the lever to its normal position, effecting release of the energy in the springs 74 in the process.

As shown in FIG. 7, the shaft 152 may extend, as at 212 beyond the support plate 127. The latch operator 144, described above, selectively rotates the shaft 152 clockwise to permit release of the springs 74 so that the contacts 50 and 52 are separated. The shaft extension 212 may carry extra elements (not shown) similar to the shaft rotating mechanism 164 and the flipper 170. These elements may be operated by an extra arm or the like (not shown) carried by one of the recocking arms 114 to similarly rotate the shaft 152 clockwise resulting in separation of the contacts 50 and 52. In this event, the handle 111, or a modified version thereof, could be connected to and moved by a so-called shunt trip mechanism (not shown) that is, a mechanism which effects separation of the contacts 50 and 52 for reasons not necessarily related to the current in the circuit 18,20. Such other reasons might include overpressure in the transformer 16 or simply the desire to interrupt the circuit 18,20 for any purpose. The fact that the handle 111 and the recocking arms 114 may be rotated 15° without danger of the studs 115 being struck by the end member 76 means that such 15° rotation may be utilized to rotate clockwise the shaft 152 independently of the latch operator 144. Specifically, counterclockwise rotation of the recocking arms 114 through the 15° permitted, would cause the extra arm (not shown) on one of the recocking arms 114 to abut and move the extra cam arm (not shown) on the extra flipper clockwise. This would rotate the shaft 152 clockwise to effect separation of the contacts 50 and 52. Upon return of the recocking arms 114 by the return spring 116 to their normal position, the extra arm would bypass the extra cam arm (not shown) on the extra flipper (not shown) in a manner similar to the bypassing of the flipper 170 by the clockwise rotating roller 190.

Figure 12:
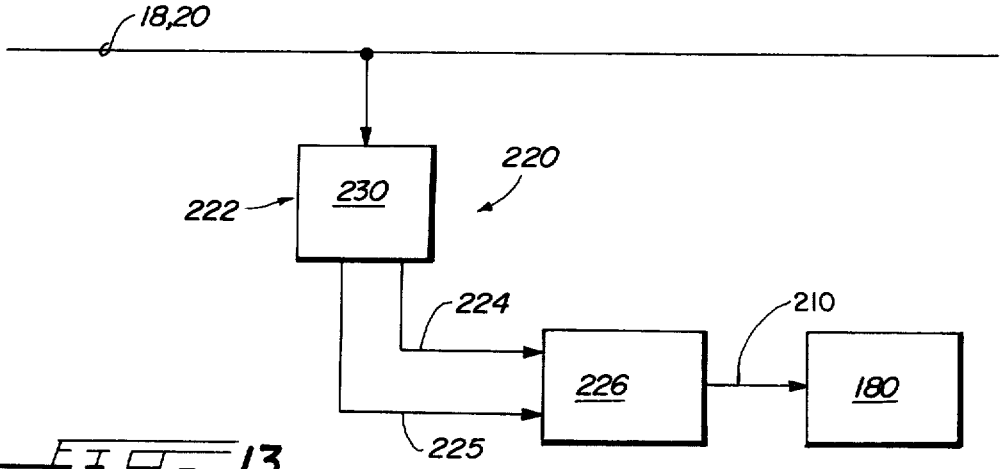
FIG. 12 is a generalized block diagram of a circuit usable with the operating mechanism of the preceding Figures.
Figure 13:
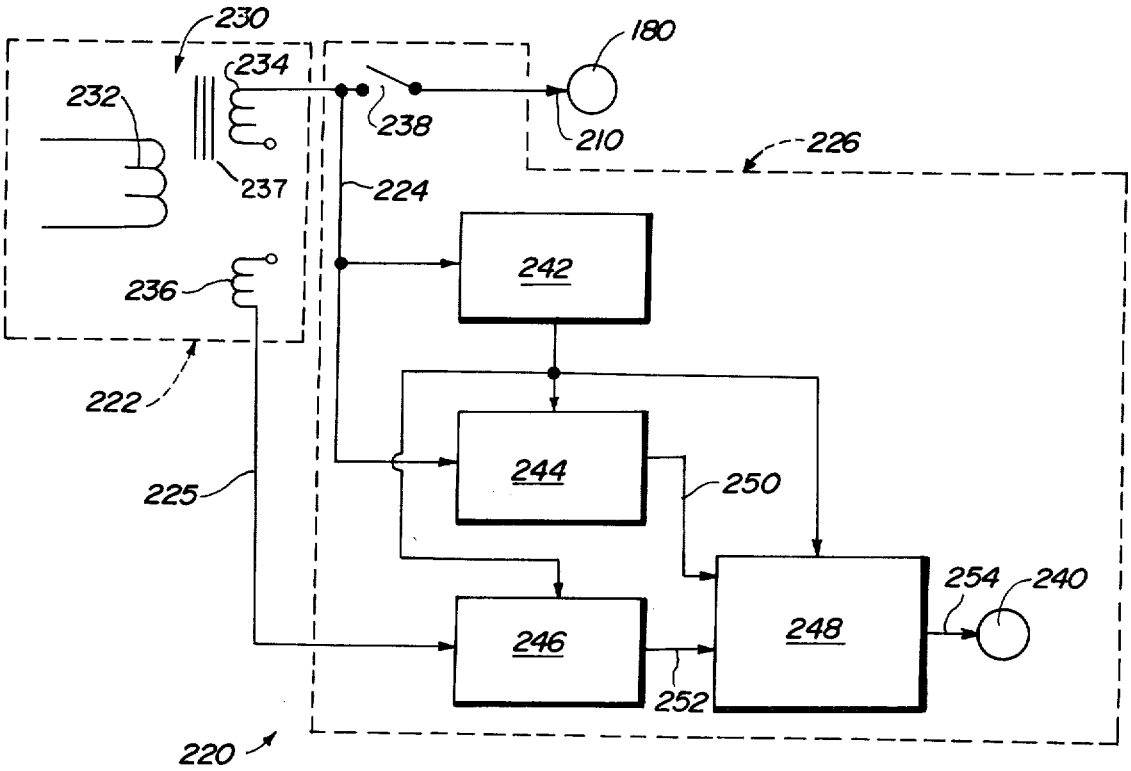
FIG. 13 is a more detailed block diagram/schematic of the circuit of FIG. 12.

Solenoid Circuit 220—FIGS. 12 and 13

FIG. 12 is a diagrammatical schematic of a circuit 220 which operates the solenoid 180 and the tripping mechanism 72 as a consequence. A sensor 222 detects the current level in the circuit 18,20, for example in one of the buses 18 or 20, and generates on output leads 224 and 225 electrical signals which are functions of this current level. These output signals are fed to a processing unit 226 which places on the leads 210 to the solenoid 180 one of three signals:

(1) If the current level in the circuit 18,20 is normal, and less than a predetermined minimum fault or overcurrent level, no or zero output is imposed on the leads 210. In this event, the solenoid 180 does not operate and the contacts 50 and 52 remain engaged.

(2) If the current level is abnormal, and is greater than the predetermined minimum fault or overcurrent level but less than a predetermined maximum fault or overcurrent level, the processing unit 226 imposes on the leads 210 a momentary signal of sufficient duration and magnitude to momentarily energize the solenoid 180. Such action effects opening of the contacts 50 and 52 to interrupt the circuit. The range of currents between the minimum and maximum predetermined fault or overcurrent levels is the range of currents which the interrupting unit 12 is designed to interrupt.

(3) If the current level exceeds the predetermined maximum fault or overcurrent level, the processing unit 226 imposes on the leads 210 a persistent signal of sufficient magnitude to energize and maintain energized the solenoid 180. This moves the lever 186 right and keeps it there, the contacts 50 and 52 remaining closed. Ultimately, the upstream breaker or other protective device (not shown) opens. Such opening terminates the persistent signal, de-energizing the solenoid 180 and now permitting the return spring 204 to return the lever 186 to its normal position. Consequently, the contacts 50 and 52 open, to isolate the transformer 16 from the remainder of the circuit 18,20 if and when the upstream breaker subsequently recloses. This sequence prevents the device 10 from attempting to interrupt fault currents or overcurrents in excess of its interrupting rating.

The construction of a circuit 220 which functions as described above is within the skill of the art, and any circuit meeting the above functional constraints may be used. A more specific schematic of the circuit 220 shown in FIG. 12 is depicted in FIG. 13.

The sensor 222 may be a current transformer (CT) 230 having a primary 232 and a pair of secondaries 234 and 236. The secondary 234 is coupled to the primary 232 by an iron core 237. The secondary 236 is air-coupled to the primary 232. The CT 230 which only generally is shown in FIGS. 3 and 4, may be located within the housing 30 and imposes on the secondaries 234 and 236 signals derived from the current flowing in one of the buses 18 or 20, as is well known. In FIG. 1, the secondary signals are derived from the current flowing in the bus 20, because the CT 230 is associated with the terminal pad 36. Accordingly, the output of the secondary 234 is proportional to the current flowing in the bus 20. The output of the secondary 236 is proportional to the derivative (d/dt) of this current. The secondary 234 is directly connectable to one of the leads 210 to operate the solenoid 180 through the closure of normally open contact 238. The contact 238 is operated by a relay 240 in the processing unit 226. The lead 224 is connected between the secondary 234 and the inputs of both a power supply 242, and a TCC circuit 244. The lead 225 is connected between the secondary 236 and the input of a (d/dt) circuit 246. The power supply 242 supplies DC power to the circuits 244 and 246 and also to a relay control circuit 248.

The TCC circuit 244 integrates the signal present on its input 224 from the secondary 234 and imposes on its output 250 a logical output based on an integration over a selected period of time of the magnitude of the input. For example, the TCC circuit may impose on the output 250 a logical "0" as long as the integral of the input current remains below a selected level indicative of a current in the bus 20 less than a predetermined minimum fault current or overcurrent level. If the integral of the input current indicates a current in the bus 18 which exceeds the predetermined minimum fault current level, the TCC circuit 244 imposes on the output 250 a logical "1," which persists until the current in the bus 18 decreases to zero or nearly so.

The di/dt circuit 246 measures the signal present on its input 225 from the secondary 236 which is proportional to the slope of the current in the bus 18 and imposes on its output 252 a logical output indicative of such input. For example, the di/dt circuit 246 may impose on the output 252 a logical "0" as long as the input thereto indicates a current in the bus 18 less than the predetermined minimum fault current or overcurrent level. If the input signal indicates a current in the bus 18 which exceeds the predetermined minimum fault current level, but is less than the predetermined maximum fault current level, the di/dt circuit 246 imposes on the output 252 a logical "1" having a limited time duration (in the nature of a pulse) after which the output 252 returns to "0." If the input signal indicates a current in the bus 18 exceeding the predetermined maximum fault current level, the di/dt circuit 246 imposes a logical "1" on the output 252 which persists until the current in the bus 18 goes to zero, at which time the output 252 returns to "0."

The relay control circuit 248 may be in the nature of a logical "AND" gate, providing on its output 254 a logical "0" if either input 250 or 252 is "0," and providing on its output 254 a logical "1" if both inputs 250 and 252 are "1." The magnitude of a "1" on the output 254 is sufficient to energize the relay 240 to close its normally open contact 238 for as long as such "1" is present on the output 254.

The characteristics of the circuits 244 and 246 may be adjustable to provide selected relay 240 operation tailored to both match the interrupting rating of the device 10 and of its interrupting unit 12, and co-ordinate with the characteristics of the upstream breaker (not shown) or other broad range interrupting device.

For purposes of this disclosure, the range of fault currents which the device 10 is designed to interrupt are those that result from faults on the secondary of the transformer 16. Fault currents through the buses 18 and 20 are thus limited by the impedance of the transformer 16. Faults on the primary side of the transformer 16 are generally these that exceed the predetermined maximum fault current level and will not be interrupted by the device 10.

Conclusion

There has been disclosed above, an interrupting device 10 which is bus mounted and operates via "intelligence" at bus or line potential. The device 10 is re-usable, and to that end is manually resettable from the ground. No disconnect switch in series with the device 10 is necessary, though one may be used if desired. The simplicity and low cost of the device 10 makes it attractive to ultimate users, such as utilities, where its limited fault current interrupting rating is acceptable when used in conjunction with an upstream breaker which removes excessive fault currents or overcurrents from the buses 18 and 20.

The present invention has been described with reference to a preferred embodiment, but the scope of this invention is that set forth in the appended claims. Various changes may be made to the above Detailed Description without departing from the scope of the present invention.

What is claimed is:

1. Apparatus for operating a circuit interrupting device by selectively latching and releasing a large quantum of stored mechanical energy; the device being of the type which includes a pair of relatively movable contacts which are engaged when the large quantum of energy is stored, release of the large quantum of energy separating the contacts in an interrupting medium to interrupt the circuit, wherein the apparatus comprises:

high mechanical advantage lever-link means for normally latching the large quantum of stored mechanical energy by and during the application to the lever-link means of a low latching force;

movable means for storing latching-force-removing mechanical energy during movement in a first direction in response to a first condition, and for moving in a second direction solely by the stored latching-force-removing energy in response to a second condition which follows the first condition; and ratchet means for removing the low latching force from the lever-link means in response to movement of the movable storing means in the second direction so the large quantum of energy is released.

2. Apparatus according to claim 1, in which the large quantum of stored mechanical energy applies a moving force to a movable drive member connected to the contacts, wherein:

the lever-link means comprises:

a pivoted arm, a link pivotally connected at a first end to, and between the pivot and one end of, the arm; and a lever pivoted between its ends, a first end of the lever being pivotally connected to the second end of the link, a first normal position of the lever propping the link to position the one end of the arm in the path of a movable drive member so that a majority of the moving force is applied along the arm and a minority of the moving force is applied to the first end of the lever along the link.

3. Apparatus according to claim 2, wherein:
the low latching force is applied to the second end of the lever to maintain the lever in the first normal position and to latch the large quantum of stored mechanical energy.

4. Apparatus according to claim 3, wherein:
the lever-link means further comprises:
the lever pivot being substantially closer to the first end of the lever than to the second end of the lever so that application of the low latching forces to the second end of the lever maintains the one end of the arm in the path of the movable drive member against the moving force.

5. Apparatus according to claim 4, wherein:
upon removal of the low latching force from the second end of the lever, the moving force both moves the one end of the arm out of the path of the movable drive member and concurrently moves the lever into a second position so that the moving force applied by the large quantum of stored mechanical energy is free to move the drive member.

6. Apparatus according to claim 5, wherein:
the pivotal connection between the first end of the link and the arm is offset from a line defined by the one end and the pivot of the arm.

7. Apparatus according to claim 6, wherein:
the lever-link means further comprises:
means for biasing both the one end of the arm in the path of the movable drive member and the lever toward the first normal position, the biasing means being unable to maintain the one end of the arm in the path of the movable drive member against the moving force absent the application of the low latching force to the second end of the lever.

8. Apparatus according to claim 7, wherein:
the ratchet means comprises:
a latch arm rotatable between a first normal and a second position for applying the low latching force to the second end of the lever when the lever and the latch arm are both in their first normal positions, the low latching force being applied substantially along the latch arm, rotation of the latch arm to its second position removing the low latching force from the second end of the lever.

9. Apparatus according to claim 1, wherein:
the ratchet means comprises:
a latch arm rotatable between a first normal position, whereat the low latching force is applied by the latch arm to the lever-link means and a second position, whereat the low latching force is removed from the lever-link means;
first means for biasing the latch arm to the first position;
a flipper rotatable out of a normal position in two opposite directions;
second means for biasing the flipper into its normal position; and
tooth means for permitting rotation of the flipper in a first direction without affecting the position of the latch arm, and for moving the latch arm to its second position upon rotation of the flipper in a second direction.

10. Apparatus according to claim 9, wherein:
the tooth means comprises:
a first tooth movable with the flipper; and
a second tooth movable with the latch arm, the teeth being engaged when the latch arm and the flipper are in their normal positions, rotation of the flipper from its normal position in the first direction moving the teeth apart, rotation of the flipper from its normal position in the second direction moving the first tooth against the second tooth to move the latch arm to its second position.

11. Apparatus according to claim 10, wherein:
the movable means comprises:
a rotatable trip lever having a normal first position, rotation of the trip lever out of its first position storing the latching-force-removing energy and moving the trip lever against and past the flipper to rotate the flipper in the first direction, rotation of the trip lever by the stored latching-force-removing-energy back to its first position moving the trip lever against and past the flipper to rotate the flipper in the second direction.

12. Apparatus according to claim 11, wherein:
the movable means further comprises:
third means for biasing the trip lever to its normal first position, rotation of the trip lever out of its first position storing the latching-force-removing energy in the third biasing means.

13. Apparatus according to claim 12, wherein:
the movable means further comprises:
solenoid means for rotating the trip lever out of its first position against the third biasing means in response to energization by the first condition, the latching-force-removing energy rotating the trip lever back to its first position in response to de-energization of the solenoid means by the second condition.

14. Apparatus according to claim 13, wherein:
the ratchet means further comprises:
a rotatable shaft mounting the latch arm; and
the flipper comprises:
a first body carrying the first tooth and freely rotatable on and about the shaft;
a cam arm on the first body against and past which the trip lever is movable from either side for rotation of the first body in the first and second directions of rotation of the flipper; and
a second body carrying the second tooth and mounted on the shaft, the second biasing means biasing the first tooth toward engagement with the second tooth.

15. Apparatus according to claim 14, wherein:
the lever-link means comprises:
a lever pivoted between its ends closer to a first end thereof than to a second end, the low latching force being applied along the latch arm to the second end of the lever.

16. Apparatus according to claim 1 for operating the interrupting device in response to a fault current in the circuit, wherein:
when the fault current is within the interrupting rating of the device, the first and second conditions occur in rapid succession in a short period of time, and when the fault current exceeds the interrupting rating of the device, the first condition occurs thereupon and the second condition occurs only after the circuit current is substantially zero.

17. Apparatus according to claim 16, wherein:

the movable storing means comprises:

a rotatable trip lever having a normal position, the trip lever being rotatable away from the normal position in the first direction and toward the normal position in the second direction;

mechanical energy-storage means for storing the latching-force-removing energy when the trip lever rotates from the normal position in the first direction and for rotating the trip lever back to the normal position in the second direction; and electromagnetic means for rotating the trip lever in the first direction when the electromagnetic means is energized and for permitting the stored latching-force-removing energy to rotate the trip lever in the second direction when the electromagnetic means is de-energized, the first condition effecting energization of the electromagnetic means, the second condition effecting de-energization of the electromagnetic means, the ratchet means leaving the low latching force unaffected in response to rotation of the trip lever in the first direction and removing the low latching force in response to rotation of the trip lever in the second direction.

18. Apparatus according to claim 17, wherein:

the ratchet means comprises:

a flipper rotatable from a normal position in two opposite directions, the flipper being rotated by rotation of the trip lever thereagainst and therepast from either side;

first means for biasing the flipper to its normal position; and tooth means responsive to rotation of the flipper in the first direction by movement of the trip lever in the first direction for leaving unaffected the low latching force, and responsive to rotation of the flipper in the second direction by movement of the trip lever in the second direction for removing the low latching force.

19. Apparatus according to claim 18, wherein:

the ratchet means further comprises:

a latch arm rotatable between a first position, whereat the low latching force is applied by the latch arm to the lever-link means and a second position whereat the low latching force is removed from the lever-link means;

second means for biasing the latch arm to the first position;

a rotatable shaft mounting the latch arm;

a first body carrying a first tooth and freely rotatable on and about the shaft;

a cam arm on the first body against and past which the trip lever is movable from either side for rotation of the first body in the first and second flipper directions out of the normal flipper position;

a second body carrying a second tooth and mounted on the shaft; and third biasing means for biasing the first tooth into normal engagement with the second tooth, the teeth being engaged when the latch arm is in its first position and the first body is in the normal position, rotation of the first body in its first direction moving the teeth apart, rotation of the first body in the second direction moving the first tooth against the second tooth to move the latch arm to its second position.

20. Apparatus for selectively latching and releasing a large quantum of stored mechanical energy, which comprises:

high mechanical advantage lever-link means for normally latching the large quantum of stored mechanical energy by and during the application to the lever-link means of a low latching force;

movable means for storing latching-force-removing mechanical energy during movement in a first direction in response to a first condition, and for moving in a second direction solely by the stored latching-force-removing energy in response to a second condition which follows the first conditions; and ratchet means for removing the low latching force from the lever-link means in response to movement of the movable storing means in the second direction.

21. An operating mechanism for selectively latching and releasing stored mechanical energy to selectively engage and separate the contacts of a high voltage circuit interrupting device connectable in a high voltage circuit, the device having a predetermined maximum current interrupting rating, the apparatus comprising;

means for sensing the current in the circuit and for generating a first signal when the current is less than a fault current, a second signal when the current is a fault current not exceeding the predetermined rating, and a third signal when the current is a fault current exceeding the predetermined rating; and means for latching the stored energy in response to the first signal, releasing the stored energy in response to the second signal, and releasing the stored energy in response to the third signal only after the current is substantially zero.

22. A mechanism according to claim 21, wherein:

the latching and releasing means comprises;

a trip lever movable between a normal first position and a second position;

ratchet means for normally latching the stored energy and for releasing the stored energy only if the trip lever moves sequentially from the first position to the second position and then back to the first position; and electromagnetic means for maintaining the trip lever in its first position in response to the first signal, for moving the trip lever to its second position and then back to its first position in response to the second signal, and for first moving the trip lever to its second position in response to the third signal and then moving the trip lever to its first position in response to the current being substantially zero.

23. A mechanism according to claim 22, wherein:

the trip lever is pivoted on its first end for moving its second end between the first and second positions;

the ratchet means includes spring-loaded flipper means contactable by the second end of the trip lever for permitting free movement from the first to the second position of the second end of the trip lever without releasing the stored energy, and for releasing the stored energy as the second end of the trip lever moves from its second position back to its first position; and the electromagnetic means includes solenoid means connected to the trip lever for moving the second end of the trip lever to its second position in response to the second and third signals, and means for continuously biasing the second end of the trip lever to its first position.

24. A mechanism according to claim 23, wherein:

the first signal has a magnitude insufficient to cause the solenoid means to move the second end of the trip lever against the biasing means;

the second signal has a limited duration and a magnitude sufficient to cause the solenoid means to move the second end of the trip lever to its second position after which duration the second end of the trip lever is returned to its first position by the biasing means; and the third signal has an extended duration substantially equal to the time between inception of the fault current and the current becoming zero and a magnitude during this extended duration sufficient to cause the solenoid means to move the second end of the trip lever to its second position, the second end of the trip lever remaining in its second position during the extended duration of the third signal.

25. A mechanism according to claim 24, wherein:

the latching and releasing means further comprises:

a lever pivoted between its ends closer to a first end thereof then to a second end thereof, means for selectively maintaining the stored energy in the latched state for releasing the stored energy, and means for interconnecting the first end of the lever and the maintaining means so that, as long as the second end of the lever is held fixed in a predetermined location, the stored energy remains latched, and so that, if the second end of the lever is not held in the predetermined location, the stored energy is free to move the first end of the lever to disable the maintaining means and become released; and, wherein the ratchet means comprises:

means for normally holding the second end of the lever fixed in the predetermined location and for not holding the second end of the lever fixed in the predetermined location only upon the second end of the trip lever moving from the second to the first position.

26. An operating mechanism for a circuit interrupting device, the device being of the type which has a pair of normally engaged, separable contacts which carry current in the circuit; the operating mechanism storing mechanical energy for selectively separating the contacts in an arc extinguishing medium; the device having the capability of interrupting fault currents greater than a first level but less than a second level; the operating mechanism comprising:

sensing means responsive to the current level in the circuit for generating a first signal if the circuit current is less than the first level, generating a second signal if the circuit current is greater than the first level and less than the second level, and generating a third signal if the circuit current is greater than the second level; and tripping means responsive to the signals for latching the stored energy to maintain the contacts engaged in response to the first signal, releasing the stored energy to separate the contacts in response to the second signal, and first latching the stored energy to maintain the contacts engaged and then releasing the stored energy to separate the contacts in response to the third signal only after cessation of circuit current greater than the second level.

27. A mechanism according to claim 26 wherein:

the first signal has a constant first magnitude;

the second signal has a second magnitude greater in absolute value than the first magnitude and a first duration; and the third signal has the second magnitude and a second duration at least equal to the time between inception of a circuit current greater than the first level and the dropping of the circuit current to less than the second level.

28. A mechanism according to claim 27, wherein:

the tripping means comprises:

solenoid means having a first normal position and a second position, the solenoid means remaining in the first position in response to the first signal and moving to the second position in response to, and for the duration of signals of the second magnitude, the solenoid means returning to the first position following cessation of a signal of the second magnitude; and ratchet means and lever-link means for latching the stored energy to maintain the contacts engaged in response to the solenoid means either remaining in the first position or moving to the second position, and for releasing the stored energy to separate the contacts in response to the solenoid means returning to the first position from the second position.

* * * * *